United States Patent [19]

Johnson

[11] 4,287,870

[45] Sep. 8, 1981

[54] INDOOR BARBEQUE COOKING DEVICE

[76] Inventor: John Johnson, 3695 Hunter St., Glen Avon Heights, Calif. 92509

[21] Appl. No.: 28,058

[22] Filed: Apr. 9, 1979

Related U.S. Application Data

[63] Continuation-in-part of Ser. No. 889,754, Mar. 24, 1978, Pat. No. 4,185,611, which is a continuation-in-part of Ser. No. 713,888, Aug. 12, 1976, Pat. No. 4,088,144.

[51] Int. Cl.[3] ..... A47J 37/00; F24B 7/00; F23H 13/00

[52] U.S. Cl. ..... 126/25 C; 126/121; 126/164; 126/163 R

[58] Field of Search ..... 126/77, 25 C, 121, 66, 126/163, 164; 431/79

[56] References Cited

U.S. PATENT DOCUMENTS

| | | | |
|---|---|---|---|
| 59,620 | 11/1866 | McCleary | 126/164 |
| 463,061 | 8/1892 | Lewis | 126/132 |
| 831,096 | 9/1906 | Posey | 126/122 |
| 1,313,085 | 8/1919 | Greene | 126/121 |
| 1,755,970 | 4/1930 | Singleton | 431/79 |
| 2,052,643 | 8/1936 | Modine | 126/121 |
| 3,756,140 | 9/1973 | Kolivas | 126/25 C |
| 3,911,894 | 10/1975 | Richard, Jr. et al. | 126/121 |
| 3,942,509 | 3/1976 | Sasser | 126/121 |
| 4,008,703 | 2/1977 | Allgood | 126/121 |
| 4,010,729 | 3/1977 | Egli | 126/121 |
| 4,018,209 | 9/1977 | Ronvicini | 126/121 |
| 4,140,101 | 2/1979 | Glover | 126/66 |
| 4,174,704 | 1/1979 | Zimmer | 126/77 |

FOREIGN PATENT DOCUMENTS

| | | | |
|---|---|---|---|
| 556543 | of 1896 | United Kingdom . | |
| 651856 | of 1900 | United Kingdom . | |
| 24575 | of 1859 | United Kingdom . | |
| 862063 | 3/1961 | United Kingdom | 126/25 C |

OTHER PUBLICATIONS

Brochere of Jenn-Air Grille Range.
Brochere of Thermograte.
Brochere of Heat-A-Thon.
Brochere of Turb-O-Heat.
*Popular Science,* 11/77, pp. 51,52.

*Primary Examiner*—Samuel Scott
*Assistant Examiner*—Wesley S. Ratliff, Jr.
*Attorney, Agent, or Firm*—Knobbe, Martens, Olson, Hubbard & Bear

[57] ABSTRACT

An indoor barbecue cooking device comprises a grill and a removeable oven cover so that the device can be used either as a barbecue grill or a barbecue oven. The device includes an electrically powered air blower which is selectively and automatically activated by either a thermostat or a photocell. When the device is used as a grill, the blower is automatically activated in response to the detection of an open flame by the photocell to blow the flame out so that the food is prevented from being burned. When the device is used as an oven, the blower is automatically activated by the thermostat when the selected temperature is exceeded, so that cooling air is blown into the oven to maintain the selected temperature.

10 Claims, 7 Drawing Figures

Fig. 1
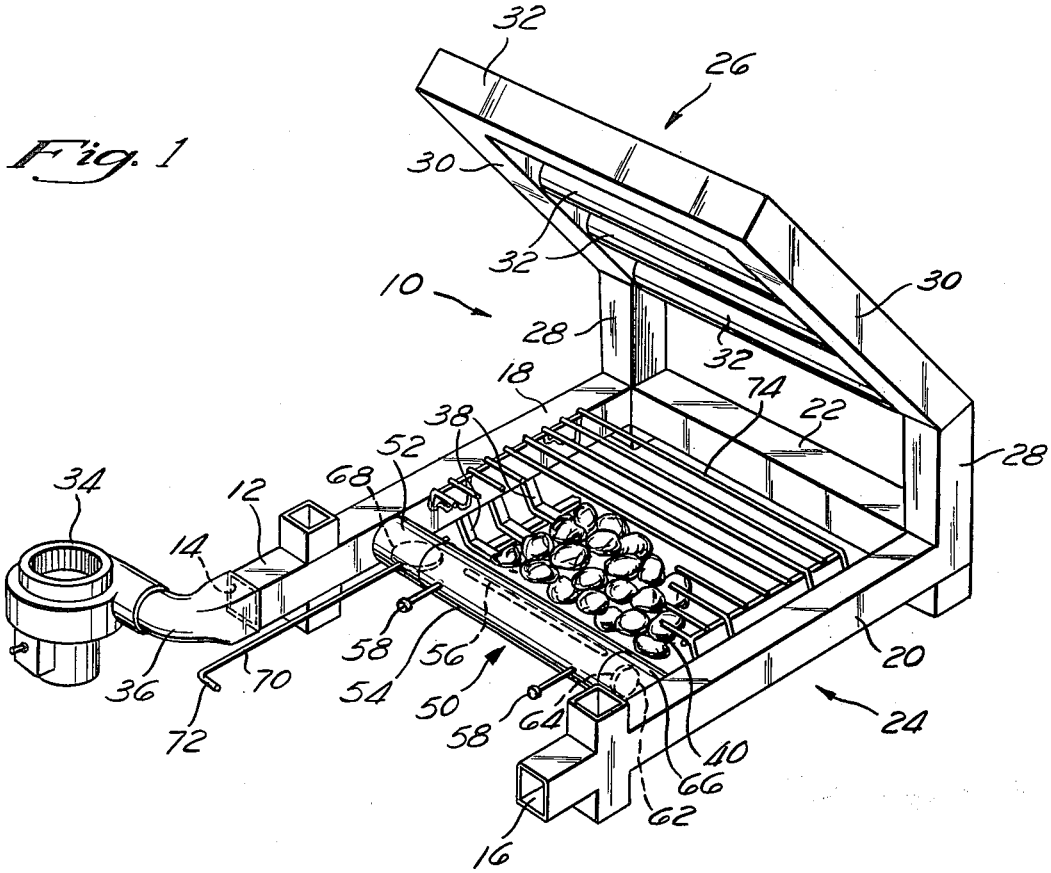
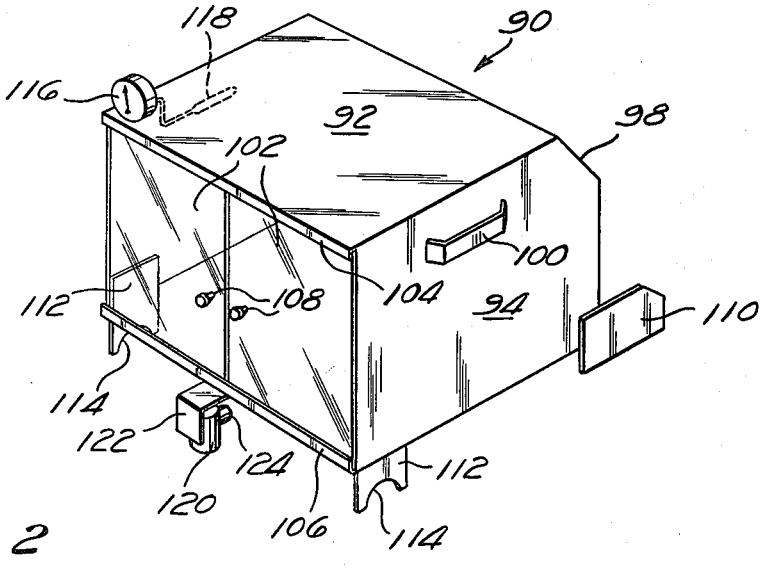
Fig. 2

Fig. 3
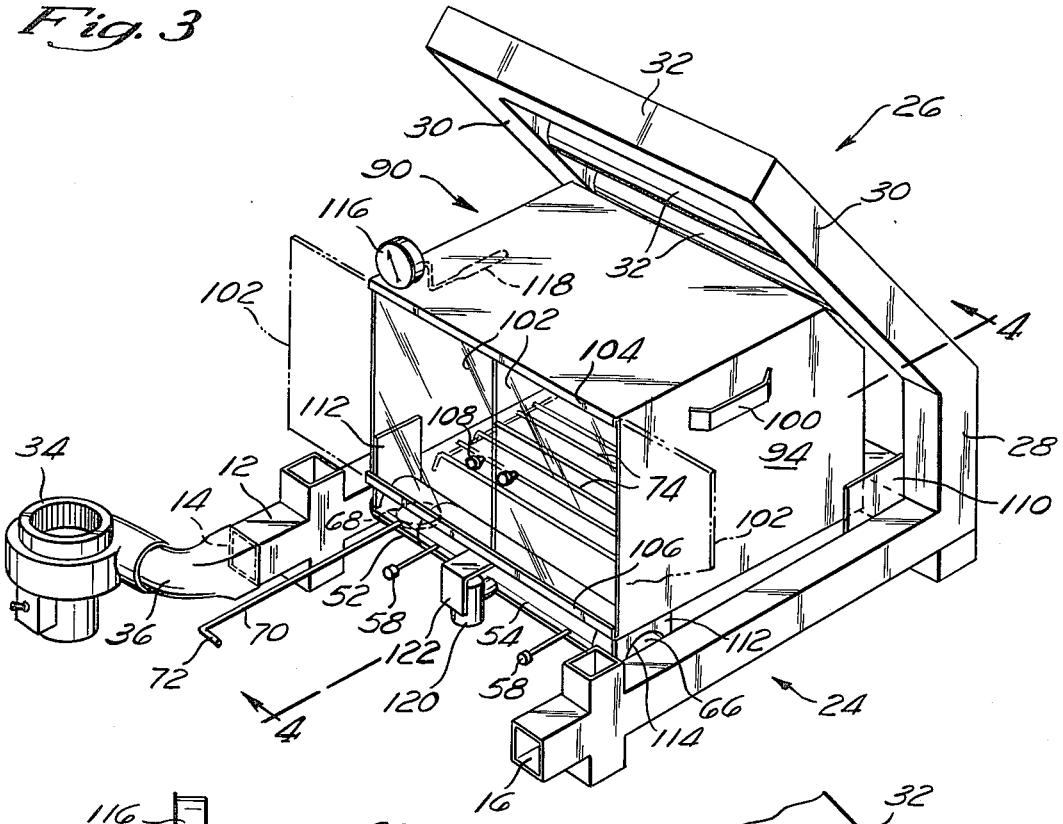
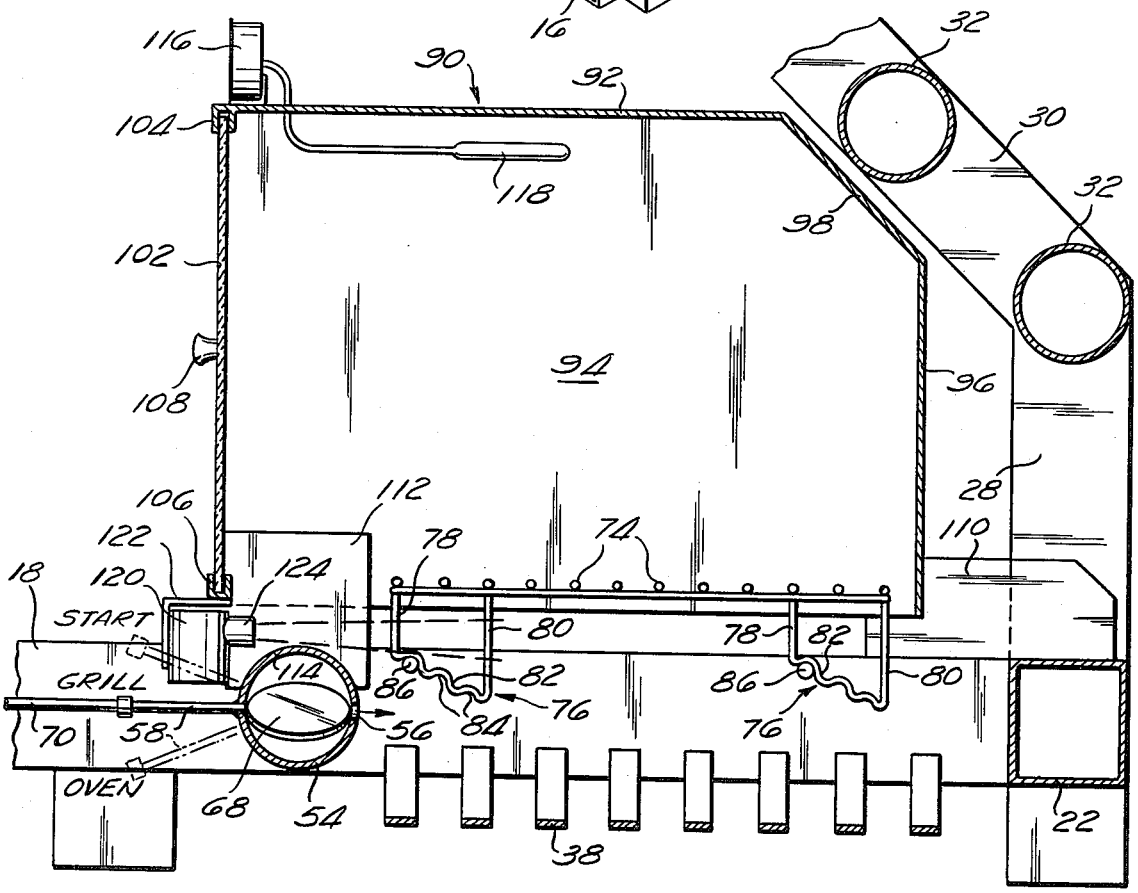
Fig. 4

Fig. 5
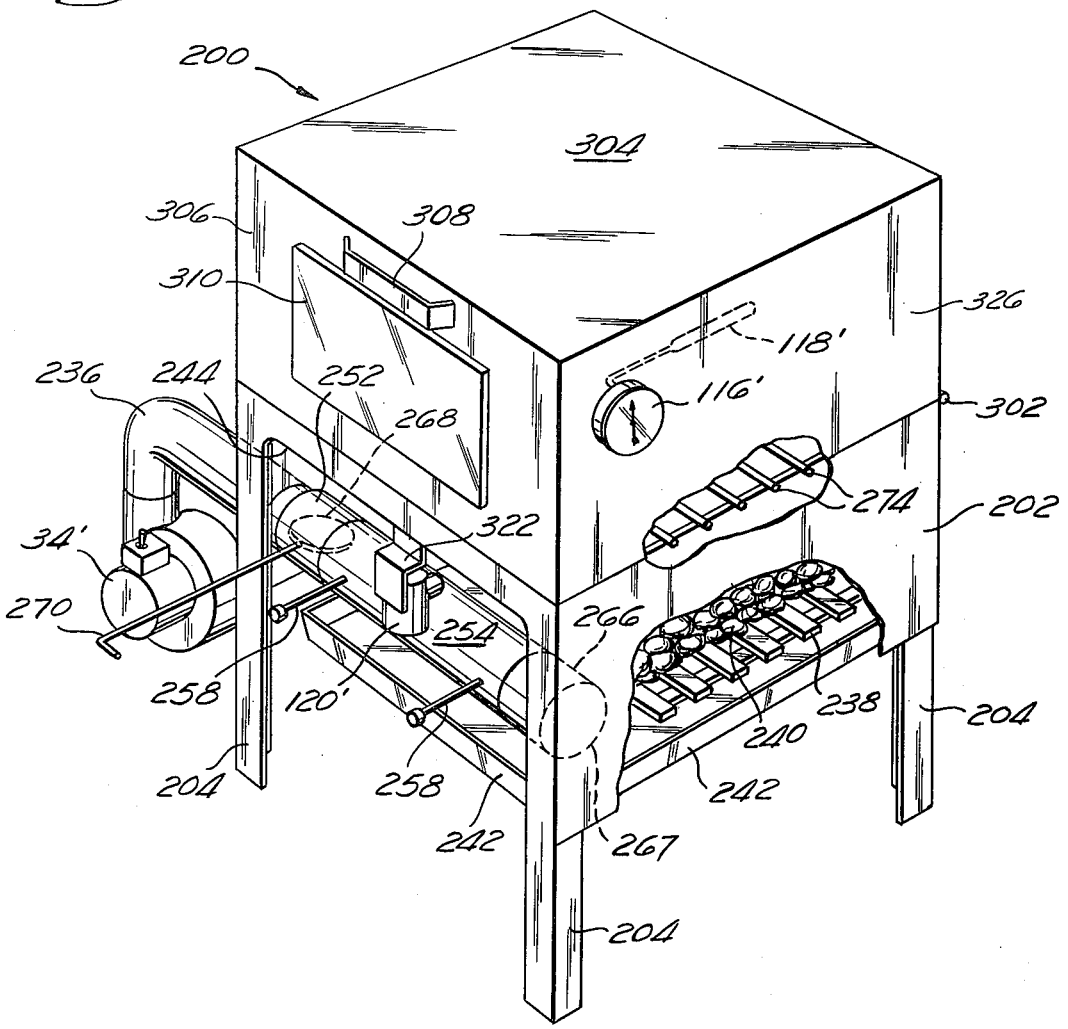
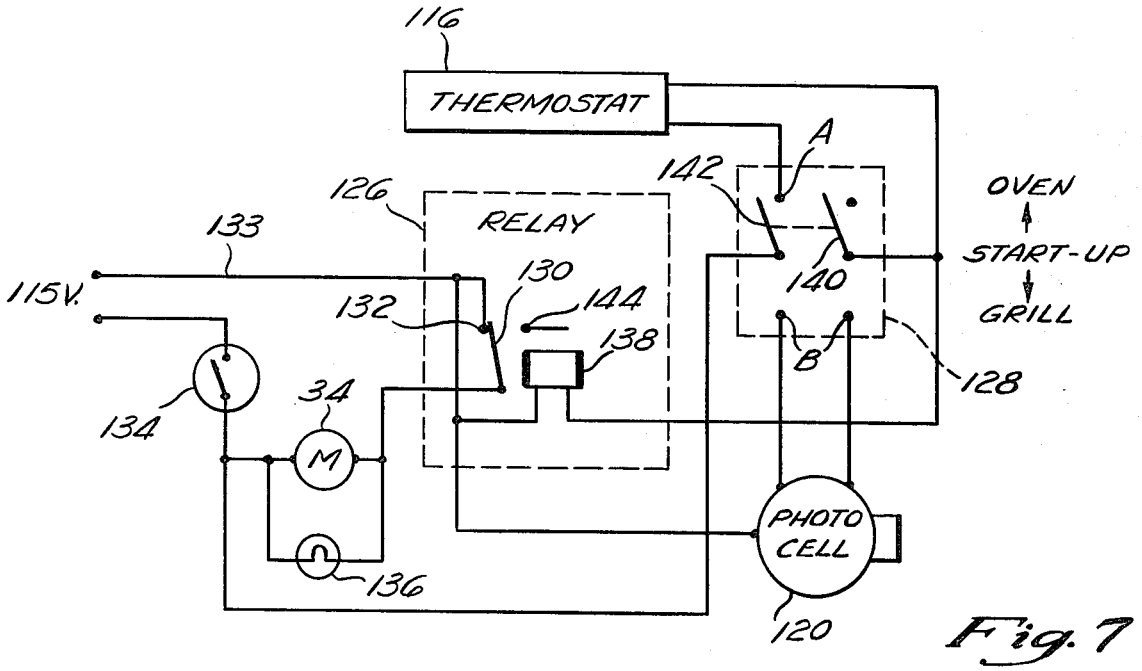
Fig. 7

INDOOR BARBEQUE COOKING DEVICE

CROSS REFERENCE TO RELATED APPLICATION

This application is a continuation-in-part of co-pending application Ser. No. 889,754, filed Mar. 24, 1978, now U.S. Pat. No. 4,185,611; which, in turn, is a continuation-in-part of application Ser. No. 713,888, filed Aug. 12, 1976, which is now U.S. Pat. No. 4,088,144.

BACKGROUND OF THE INVENTION

The barbecuing of food has become increasingly popular in recent years, largely due to the unique flavor imparted to the food by the barbecuing process, and also due to the fact that barbecuing is a relatively simple way of providing tastily cooked food. A major drawback to barbecuing, at least until recently, has been the fact that the smoke and gaseous combustion byproducts resulting from the barbecuing have severely limited its use indoors. One fairly recent approach to overcoming this limitation has been to provide a barbecue grill in a cooking range along with an air blower and air ventilation means to exhaust the noxious fumes. While this approach has achieved satisfactory results, it requires the construction of a ventilation system including an exhaust vent to the outdoors. The installation of such a system often requires considerable expense.

Another drawback to barbecuing is the lack of means for controlling the temperature of cooking. Thus, methods of cooking such as baking, which require a regulated temperature, cannot be done with a barbecue.

A further problem of barbecuing is familiar to anyone who has cooked by this method, and that is the problem of burnt food. This problem is especially acute in the cooking of meat, since fat dripping onto the hot briquettes often ignites into a flame which can char the meat. Thus, the barbecue must be constantly watched to prevent the meat from charring.

SUMMARY OF THE INVENTION

The preferred embodiment of the present invention provides a novel combination of fireplace heater and barbecue grill and oven, using the fireplace heater disclosed and claimed in my U.S. Pat. No. 4,088,114, the disclosure of which is incorporated herein by reference. As disclosed in the aforementioned patent, the fireplace heater comprises a continuous network of hollow tubular members situated in a fireplace. The tubular members provide a continuous air conducting conduit which absorbs heat from the fireplace while air propelled by suitable air-moving means, such as, for example, a squirrel cage blower, passes through the tubular members absorbing heat therefrom. The tubular members are arranged so that there are no areas of significant counter flow in the air conduit formed by the tubular members.

As used in the present invention, the fireplace heater is provided with a variable direction air jet, as disclosed and claimed in my co-pending application Ser. No. 889,754, filed Mar. 24, 1978. To provide this air jet, a slot is formed in one of the tubular members forming air conducting conduits to provide an air jet portion. This air jet portion is rotatable along a horizontal axis so that the direction of the air jet may be adjusted.

In the preferred embodiment of the invention, the air conducting conduit formed by the tubular members has a bottom portion which is provided with a grate for fuel such as charcoal briquettes. This bottom portion forms a first heat absorbing portion and is in air flow communication with a second heat absorbing portion extending into the area above the fuel. This second heat absorbing portion is, thus, in the area which is above the fuel, which is the area of rising hot air from the fuel, and, therefore, is the area of greatest heat concentration. In this embodiment, the air passage of the air conducting conduit extends from an entrance opening in the conduit, through the first lower heat absorbing portion and then to the second upper heat portion and finally to an exit opening. This configuration provides a very efficient utilization of the heat provided by the burning fuel so that less fuel is needed to cook the food. In this configuration, the air jet member is located in the bottom heat absorbing portion and is oriented so that the air jet slot is aimed in the general direction of the fuel contained in the grate.

Since the primary purpose of the invention is to provide an indoor barbecue, the lower heat absorbing portion is provided with a rack or grill on which the food is cooked. Removeably mounted on the lower heat absorbing portion over the grill is an open-bottomed enclosure having sliding front doors of heat-resistant glass. With the sliding front doors open, cooking is done by open grilling; while when the sliding doors are closed, the enclosure acts as an oven for baking or roasting.

The enclosure is provided with both a photocell and a thermostat which are connected through a relay to the motor of the air blower which blows air through the air conduit. The thermostat and the photocell serve as heat and light sensing means, respectively, and serve automatically to activate the blower when predetermined levels of heat and light, respectively, are sensed. A function selector switch is provided so that the blower is selectively activated by the thermostat alone and by the photocell alone. The switch also includes a "start-up" position which excludes the thermostat and the photocell from the blower motor circuit so that the blower can be run continuously without regard to the detected levels of heat and light.

When barbecuing by the open-grill method is desired, the sliding glass doors of the enclosure are maintained in the open position and the aforementioned switch is set in a position in which the blower is automatically activated by the photocell. The air jet member is rotated so that the air jet slot is aimed toward the charcoal briquettes. When dripping fat and grease from the cooking food ignites into a flame, the light from the flame is detected by the photocell, and the blower is activated. This causes a jet of air to be directed towards the flame, blowing it out. When the flame has been thus extinguished, the blower is de-activated. Thus, the burning or charring of the food is automatically prevented.

When baking or roasting is the desired method of cooking, the sliding glass doors of the enclosure are maintained in the closed position so that the enclosure provides an oven. The aforementioned switch is set to the position in which the blower is automatically activated in response to the thermostat, which is set at the desired temperature. The air jet member is rotated so that the air jet slot is directed upwardly into the oven provided by the enclosure. When the selected temperature in the oven is exceeded, the thermostat activates the blower so that cooling air is directed into the oven from the air jet member until the oven is cooled down to the selected temperature. In this manner, the invention provides a means for barbecuing, baking or roasting with regulated temperatures.

Thus, the invention provides controlled and regulated barbecue cooking by means of the air jet, which is automatically activated by either the thermostat or the photocell.

With either the grilling or baking method of cooking, of course, the smoke and noxious gases from the burning fuel are vented up the chimney in the normal manner of a typical fireplace.

When it is desired to use the fireplace for space heating, the enclosure and grill are removed from the fireplace heater, and logs (or similar fuel) and placed in the grate. With the function selector switch set in the "start-up" position, the fireplace heater can be used for space heating in the manner taught in my aforementioned patent and my co-pending application. The present invention thus provides a novel accessory for my fireplace heater, which converts the heater into a dual function device.

An alternative embodiment of the invention provides the same barbecue cooking capabilities as the preferred embodiment in a structure adapted more for a permanent or semi-permanent installation.

Thus, it can be seen that the present invention provides a safe and convenient means for indoor barbecuing, while at the same time providing for regulated temperature cooking and substantially eliminating the problem of charred food.

BRIEF DESCRIPTION OF THE DRAWINGS

FIG. 1 is a front perspective view of the fireplace heater used in the preferred embodiment of the present invention;

FIG. 2 is a front perspective view of the oven enclosure used in the preferred embodiment of the present invention;

FIG. 3 is a front perspective view showing the oven enclosure of FIG. 2 mounted on the fireplace heater of FIG. 1;

FIG. 4 is a cross-sectional view along line 4—4 of FIG. 3;

FIG. 5 is a front perspective view of an alternative embodiment of the invention;

FIG. 7 is a schematic representation of the electric circuit used in the present invention.

DETAILED DESCRIPTION OF THE INVENTION

Construction of the Preferred Embodiment

Figure 6:
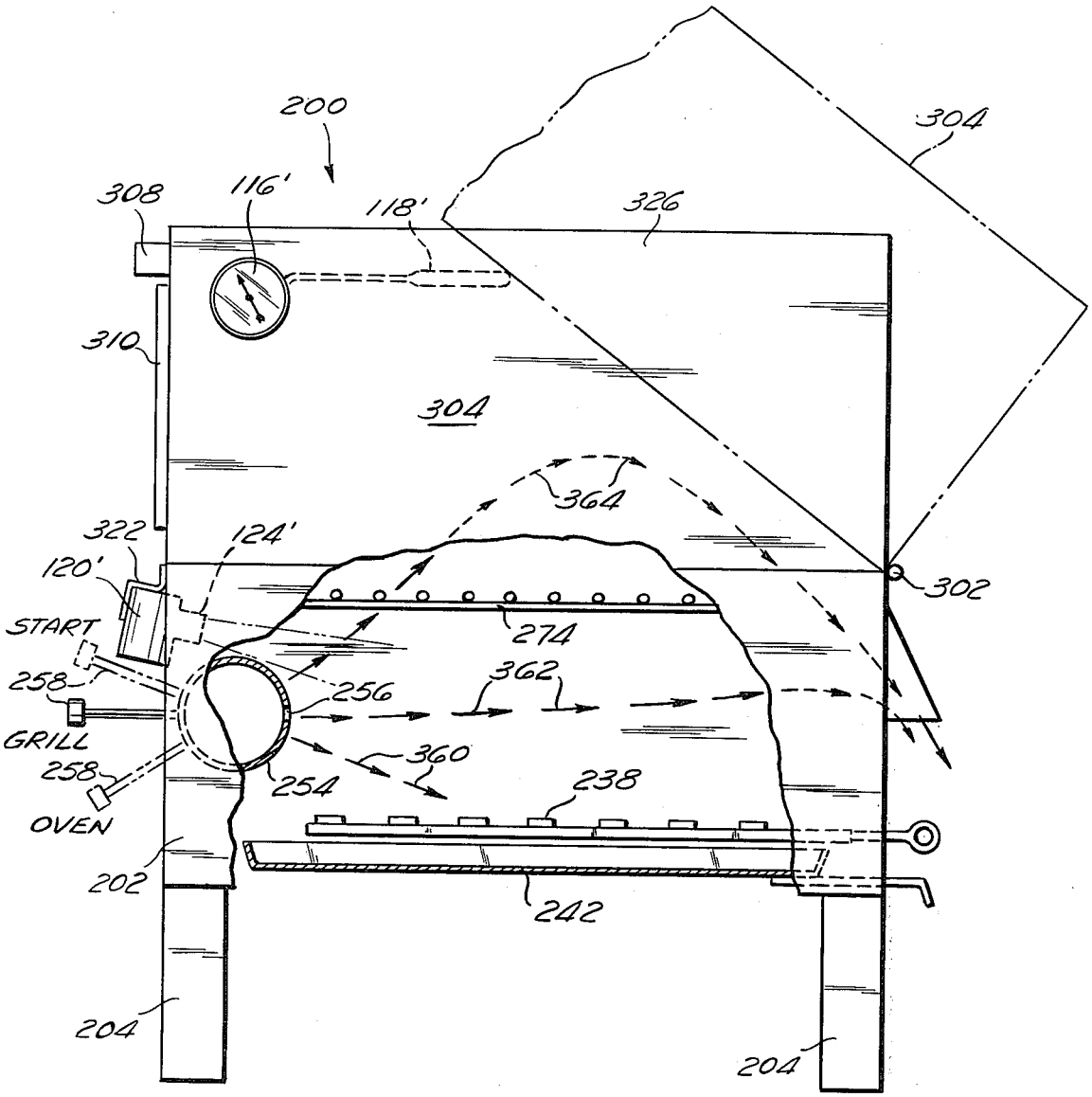
FIG. 6 is a side elevational view partially in section of the alternative embodiment of FIG. 5.

Referring first to FIG. 1, the preferred embodiment of the present invention utilizes a fireplace heater 10 as disclosed and claimed in my U.S. Pat. No. 4,088,114, the disclosure of which is incorporated herein by reference. Briefly, the fireplace heating unit 10 is comprised of an air conducting conduit 12, the interior wall of which forms an air passage. The conduit 12 has an inlet or entrance opening 14 and an outlet or exit opening 16 which are located at the front of the fireplace. The conduit 12 comprises a first leg 18 extending longitudinally from the inlet opening 14 rearwardly into the fireplace (not shown); a second longitudinal leg extending forwardly from the rear of the fireplace to the outlet opening 16 and a transverse leg 22 extending across the rear of the fireplace and connecting to rear-most extremities of the longitudinal legs 18 and 20. These hollow members or legs 18, 20 and 22, which are preferably made of seamless steel tubing, together form a first or lower heat absorbing portion 24.

An upper heat absorbing portion 26 is connected to and in fluid communication with the lower heat absorbing portion 24 via a pair of short vertical hollow legs 28. The upper heat absorbing portion 26 comprises a pair of hollow side legs 30 extending upwardly and forwardly from the tops of the short hollow vertical legs 28 at an angle of approximately 30 to 60 degrees with the preferred angle being approximately 45 degrees. Connecting the two upwardly angled side legs 30 are two or more transverse hollow members 32.

Suitable air blowing means, such as a squirrel cage blower 34, are coupled to the inlet opening 14, preferably by a flexible hose 36. With the configuration shown in the drawings and described above, air flows from the blower 34 into the inlet opening 14 through the continuous air passage formed by the legs 18, 22, 28, 30, 32 and 20 and out the exit or outlet opening 16 substantially without counterflow and therefore without any significant areas of stagnation, as explained in detail in my aforementioned patent. In the present invention, a grate 38 for holding fuel such as charcoal briquettes 40 is mounted in the lower heat absorbing portion 24 between the legs 18 and 20. When the fuel on the grate is burning, air flowing through the fireplace heater 10 absorbs heat through the hollow metal members or legs which form the heating unit, and this air leaves the exit opening 16 and flows into the room at an elevated temperature.

The present invention makes use of an air jet assembly 50, as disclosed and claimed in my co-pending application Ser. No. 889,754, filed Mar. 24, 1978. The air jet assembly 50 comprises a hollow tubular section 52, the inlet end of which is fixed to, and in air flow communication with, the leg 18 of the lower heat absorbing portion 24. The other end of the fixed tubular section 52 communicates with a hollow tubular center section 54 which is rotatable about its longitudinal axis. This center section 54 is provided with a longitudinal slot-shaped air jet outlet aperture or nozzle 56. Diametrically opposed to the nozzle 56 and affixed to the exterior surface of the central tubular section 54 are one or more handles 58 which permit the rotatable center section 54 to be rotated about its longitudinal axis by a fireplace poker or other suitable implement. The end of the rotatable center section 54 opposite the fixed tubular section 52 is sealed with a cap 62 which is fixed to the interior surface of the rotatable center section 54 and extends outwardly therefrom. The portion of the cap 62 which protrudes from the rotatable center section 54 forms a cylindrical neck 64, the exterior surface of which has a snug rotating fit with the interior surface of a second fixed tubular section 66 which is fixed at a right angle to the leg 20 of the lower heat absorbing section 24. By sealing the center section 54, the cap 64 prevents ashes, sparks and other residue from the burning fuel which may fall through the slot 56 from being thrown into the leg 20 and into the room through the exit opening 16.

The interior of the fixed tubular section 52 is provided with a damper 68 which is rotatable about an axis which is normal to the longitudinal axis of the tubular section 52. The damper 68 is turned so as to open or close the interior of the tubular section 52 by means of a pivot handle 70 which extends forwardly through the wall of the fixed tubular section 52 toward the front of the unit. The handle 70 terminates in a right angle bent portion 72 which facilitates the turning of the handle 70 to rotate the damper 68.

In the present invention, the fireplace heating unit 10 is used for cooking. Consequently, the lower heat absorbing portion 24 is advantageously fitted with a grill 74 mounted over the grate 38 between the heat absorbing legs 18 and 20. The grill 74 is preferably provided with height adjustment means such as that shown in FIG. 4. As illustrated, the height adjustment means comprises a support member 76 proximate each corner of the grill 74. Each support member 76 has a short front leg 78 and a longer rear leg 80 extending downwardly from the grill 74. The bottom ends of the leg 78 and 80 are connected by a downwardly and rearwardly sloping member 82 having plural indentations 84. The grill 74 is removeably seated upon a plurality of pegs 86 extending inwardly from the heat absorbing legs 18 and 20. There are preferably four such pegs 86, one proximate each of the supports 76. The pegs 86 are adapted to engage the indentations 84 in the sloping members 82. In this manner, each of the indentations 84 provides a separate level or height for the grill 74. Removeably mounted in this manner, the grill 74 can easily be removed for cleaning or for placing logs on the grate 38 when it is desired to use the heating unit 10 for room heating as disclosed in my aforementioned patent.

Referring now to FIGS. 2, 3 and 4, an open-bottomed cooking enclosure 90 is shown. The enclosure 90 has a top 92, side walls 94 and a rear wall 96. The rear of the top wall 92 and the top of the rear wall 96 are joined by an upwardly and forwardly sloping leveled portion 98, the slope of which preferably corresponds to the slope of the upper heat absorbing portion 26 of the fireplace heater 10 so that the cooking enclosure 90 may extend very close to the rear of the fireplace heater. A handle 100 is preferably attached to each of the side walls 94.

The front of the enclosure 90 comprises a pair of sliding doors 102 made of a heat-resistant glass such as that marketed under the trademark "Pyrex". The doors 102 are seated in upper and lower channels 104 and 106, respectively. The upper channel 104 is attached to the front of the enclosure top 92 while the lower channel 106 is attached to the front of the side walls 94. Each of the doors 102 is advantageously provided with a knob 108.

Extending rearwardly from each of the side walls 94 is a rear support 110 adapted to rest on the top surface of the lower transverse heat absorbing leg 22. Extending downwardly from each sidewall 94 near the front of the enclosure is a front support member 112 having an arcuate cut 114 which accommodates the fixed tubular sections 52 and 66 of the air jet assembly 50. The enclosure 90 is thus removeably mounted on the fireplace heating unit 10 and can be conveniently lifted off by the handles 100 when desired.

Mounted on the top 92 of the enclosure 90 is an adjustable electric thermostat 116 of the type having a capillary tube 118. In an experimental prototype of the present invention, a Robertshaw model SE5300 commercial electric thermostat with a liquid-filled capillary tube was used with satisfactory results. The capillary tube 118 is inserted through a hole in the top 92 of the enclosure 90 so as to be located in the interior of the enclosure near the top thereof.

A photocell 120 is mounted on a bracket 122 which in turn is attached to the bottom channel 106. One type of photocell that has achieved satisfactory results in the experimental prototype of the invention referred to above is the Intermatic Model K1111 stem-mounted photo control. The photocell 120 has a lens 124 which is directed toward the area between the grill 74 and the grate 38, i.e., the area in which the charcoal briquettes 40 are burned.

The operation of the invention will best be understood with reference to FIG. 7. As shown in the schematic diagram of FIG. 7, the thermostat 116 and the photocell 120 are electrically connected to the motor of the blower 34 by a relay 126 and a double pole, double throw toggle switch 128. In the aforementioned experimental prototype, a Potter & Brumfield model KRP11A relay was used with good results.

The relay 126 has a movable contact 130 which is normally closed against a first fixed contact 132. The first fixed contact 132 is electrically connected by a line 133 to one side of the household 115 volt line. The movable contact 130 of the relay 126 is electrically connected to one terminal of the motor of the blower 34, the other terminal of which is connected through a single pole, single throw master power switch 134 to the household line. An indicator light 136 may be advantageously connected in parallel across the motor of the blower 34. The relay 126 has a coil 138 which is connected between the power line 133 and a first movable contact 140 of the double pole, double throw switch 128. Also connected to the powerline 133 is the appropriate terminal of the photocell 120. The other two terminals of the photocell (which is a three terminal device) are electrically connected to a pair of contacts "B" forming one throw of the double pole, double throw switch 128.

One of the two terminals of the thermostat 116 is connected to the first movable contact 140 of the double pole, double throw switch 128 while the other terminal of the thermostat is electrically connected to a contact "A" which is one of a pair of contacts forming the second throw of the switch 128. The switch 128 has a second movable contact 142 which is electrically connected to the household line through the power switch 134.

Operation of the Preferred Embodiment

The present invention has three modes of operation, and in describing each mode, it is to be assumed that the master power switch 134 is closed.

Prior to cooking with a barbecue, it is necessary to ignite the coals or briquettes and allow the fuel to burn fairly vigorously until the coals or briquettes become sufficiently hot to cook the food without an open flame. During this stage in the process, it is usually necessary to provide a good draft of air on the fuel to promote combustion. To accomplish this, the air jet assembly 50 is rotated by moving the handles 58 to the position marked "start" in FIG. 4 so that the air jet nozzle 56 is directed toward the grate 38 or the bottom of the fuel. With the damper 68 opened, the double pole, double throw switch 128 (which may be termed a "function selector switch") is moved to the "open" position, labeled "start-up" in FIG. 7. As will be seen in FIG. 7, the open position of the switch 128 disconnects the relay coil 138 from the house current line so that the relay 126 remains unenergized. When the relay 126 is unenergized, the movable contact 130 maintains contact with the first fixed contact 132 so that a completed electric circuit is provided for the motor of the blower 34. The blower is thus turned on when the power switch 134 is closed to blow a jet of air through the air jet nozzle or slot 56, thereby producing a draft directly onto the briquettes, which promotes the ignition of the fuel and the relatively rapid combustion thereof.

When it is desired to cook such foods as steaks, chops, hamburgers, etc., over an open grill, the doors 102 of the enclosure 90 are placed in the open position as shown in dotted outline in FIG. 3. As previously mentioned, barbecuing is preferably done without the presence of an open flame so that the burning or charring of the food is avoided. However, a troublesome problem with barbecuing, especially with respect to the cooking of meat, is that the dripping fat falling onto the hot coals or briquettes frequently ignites into an open flame so that the barbecue must be constantly watched to avoid burned or charred food.

The present invention solves this problem by providing automatic means for detecting a flame and blowing it out. The automatic flame blowout function is accomplished by rotating the air jet assembly 50 to the position labeled "grill" in FIG. 4, so that the air jet nozzle 56 is directed toward the top of or slightly above the fuel. Referring once again to FIG. 7, the function selector switch 128 is moved to the position marked "grill", so that the movable contacts 140 and 142 are closed against the fixed contacts "B". This connects the relay coil 138 to the house current line through the photocell 120. As the photocell 120 provides a normally closed circuit, the coil 138 will initially be energized so that the movable contact 130 of the relay 126 is moved away from the first fixed contact 132 and toward a second fixed contact 144 which is open circuited. The circuit of the motor of the blower 34 is then opened and the blower is off. However, when the photocell detects a flame, its internal resistance will increase to the point where it becomes, in effect, an open circuit. The coil 138 will than be de-energized so that the movable contact 130 makes contact with the first fixed contact 132, closing the blower motor circuit. As a result, the blower 34 is turned on so that a jet of air is expelled through the air jet nozzle 56 with sufficient force to blow out the flame.

Once the flame has been extinguished, the reduced amount of light striking the photocell 120 produces a correspondong reduction in its internal resistance, so that a closed circuit is once again provided for the coil 138, which again becomes energized. The movable contact 130 is consequently moved into contact with the open-circuited second fixed contact 144, so that the circuit of the blower motor is again opened and the blower 34 turned off.

The automatic flame detection and blowout means, described above, has achieved excellent results in the aforementioned experimental prototype. For example, bacon has been successfully cooked on the open grill without significant burning or charring, even though the device was left unattended except for turning the bacon over once. The flames ignited by fat dripping from the bacon were immediately detected and blown out in the manner described above.

When cooking in a manner which requires a regulated temperature, as in baking or roasting, the doors 102 of the enclosure 90 are closed so that the enclosure, in effect, becomes an oven. When the device is used in this mode of operation, the air jet assembly 50 is rotated to the position labeled "oven" in FIG. 4, so that the air jet nozzle 56 is directed upwardly into the interior of the enclosure or oven 90. The function selector switch 128 is then thrown to the position labeled "oven" in FIG. 7, so that the second movable contact 142 is closed against the fixed contact "A". With the switch 128 in this position, the relay coil 138 is connected to the line current through the thermostat 116. Since the thermostat 116 is a normally closed circuit device, the coil 138 is initially energized so that the movable contact 130 of the relay 126 opens the relay 126 and turns off the blower motor circuit in the manner previously described. When the selected temperature on the adjustable thermostat 116 is exceeded in the interior of the oven 90, as sensed by the capillary tube 118, the thermostat 116 opens, thereby deenergizing the coil 138 so that the movable contact 130 makes contact with the first fixed contact 132, thereby closing the blower motor circuit and turning the blower 34 on. The blower then blows a jet of cooling air through the air jet nozzle 56 into the interior of the oven 90, and this flow of cooling air is maintained until the interior temperature of the oven is approximately at the pre-selected temperature, at which point the thermostat once again closes, thereby opening the blower motor circuit, as previously described.

The temperature regulating means described above has demonstrated excellent results in the aforementioned experimental prototype of the invention, maintaining the temperature to within plus or minus 4° F. of the selected temperature. Moreover, the frequent circulation of air within the interior of the oven 90, which results from periodic activation of the blower in response to temperature increases in the oven, produces a very even distribution of heat within the oven, so that food is cooked evenly all around. This even distribution of heat also allows the food to be cooked faster and at a somewhat lower temperature than would otherwise be required, resulting in the saving of fuel. Moreover, in cooking meat, the even temperature distribution helps to seal in the meat's natural juices.

In all of the above-described modes of operation, the damper 68 of the air jet assembly 50 can be used to adjust the flow of air through the air jet nozzle or slot 56.

In the preferred embodiment just described, the noxious gases produced by the burning charcoal are vented up the chimney while the heat from the burning fuel is concentrated about the enclosure 90 by the heat absorbing members of the fireplace heater 10, thereby contributing to the efficiency of the device.

Description of an Alternative Embodiment

An alternative embodiment of the invention is illustrated in FIGS. 5 and 6. This embodiment is advantageously used in a permanent or semi-permanent installation, either in a fireplace or elsewhere in the home in conjunction with suitable ventilation means. This embodiment, which can also be conveniently used outdoors, operates in the same manner as the preferred embodiment and utilizes the same circuitry illustrated in FIG. 7.

As illustrated in FIGS. 5 and 6, a cooking device 200 constructed in accordance with the alternative embodiment of the invention comprises a housing 202 supported on legs 204. Suported in the housing 202 is a grate 238 for holding fuel such as charcoal briquettes 240. Disposed underneath the grate 238 in the housing 202 in an ash drawer 242. The housing 202 has a cutaway front 244 so that the ash drawer 242 can be removed for emptying.

Also mounted in the front of the housing 202 is an air jet assembly which is very similar to that used in the preferred embodiment. This air jet assembly comprises a tubular center section 254 having an air jet slot or nozzle 256 and handles 258. The center section 254 is rotatingly mounted between a first fixed tubular section 252 and a second fixed tubular section 266, the latter having a sealed end 267. A damper 268 is located in the first fixed tubular section 252 and is manipulated by a handle 270 which extends forwardly through the wall of the tubular section 252. As with the preferred embodiment, a squirrel cage blower 34' is the preferred air moving means used in conjunction with the alternative embodiment. The blower 34' is connected by a flexible conduit 236 to the inlet side of the first fixed tubular portion 252.

Removeably mounted in the housing 202 near the top thereof, is a grill 274. Pivotally attached to the rear of the housing 202 by one or more hinges 302 is an oven cover 304. The oven cover 304 closes onto the top of the housing over the grill 274 when it is desired to cook by roasting or baking, and opens, as shown in the broken outline in FIG. 6, when cooking is to be done over an open grill. The cover 304 has a front panel 306 which is advantageously provided with a handle 308 and a window 310 of heat resistant glass.

Attached to the front of the housing 202 near the top thereof is a bracket 322 on which is mounted a photocell 120'. The photocell has a lens 124' which is aimed into the interior of the housing 202 in the direction of the grate 238. Mounted in a side wall 326 of the oven cover 304 is a variable electric thermostat 116' for controlling the temperature in the oven provided by the oven cover 304. As in the preferred embodiment, the thermostat 116' is of the type having a liquid filled capillary tube 118' located in the interior of the oven cover 304 near the top thereof.

As previously mentioned, the alternative embodiment functions in exactly the same manner as the preferred embodiment, both embodiments using the circuitry of FIG. 7. Specifically, to promote the initial ignition of the charcoal briquettes, the handles 258 of the air jet assembly are rotated to the position marked "start" in FIG. 6 so that the air jet nozzle 256 is directed downwardly toward the grate 238 or the bottom of the fuel. The function selector switch 128 (FIG. 7) is opened ("start" position) so that the blower 34' runs continuously. This provides a draft of air, indicated by the arrows 360, which promotes the rapid combustion of the charcoal.

When cooking is done by the open grill, the handles 258 are rotated to the position marked "grill" in FIG. 6 so that the air jet nozzle 256 is directed more or less straight ahead, toward the top of the fuel. The oven cover 304 is placed in the open position, as shown in the broken outline of FIG. 6. The function selector switch 128 is moved to the position labeled "grill" (FIG. 7), so that the motor of the blower 34' is activated in response to the photocell 120'. Thus, when the photocell 120' detects a flame, the blower 34' is turned on, providing a flame-extinguishing jet of air (indicated by the arrows 362 in FIG. 6) from the nozzle 256.

When cooking is to be done by baking or roasting requiring a controlled temperature, the oven cover 304 is placed in the closed position, and the handles 258 are placed in the position marked "oven" in FIG. 6 so that the air jet nozzle 256 is aimed upwardly into the interior of the oven cover 304. The function selector switch 128 is moved to the position marked "oven" in FIG. 7 so that the blower motor is activated in response to the thermostat 116'. The thermostat 116' is set to the selected temperature and when this selected temperature is exceeded (as sensed by the capillary tubes 118') the blower is turned on, providing a cooling jet of air as indicated by the arrows 364 of FIG. 6. This cooling jet of air is maintained until the oven is cooled down approximately to the selected temperature.

I claim as my invention:

1. A cook device comprising means for holding fuel;

means for holding food to be cooked;

means for selectively enclosing said food-holding means to provide an oven;

means for blowing air;

air jet means, in air flow communication with said air-blowing means (for) selectively moveable between a first position directing a jet of air toward the fuel in said fuel holding means (or) and a second position directing air into said oven;

light-sensing means for activating said air blowing means in response to the detecting of an open flame in said fuel-holding means so that said flame is extinguished by a jet of air from said air jet means when said air jet means is directed toward the fuel in said air jet means, thereby preventing the charring of said food, and heat-sensitive means for activating said air blowing means in response to the presence of a temperature in said oven which is greater than a selected temperature so that said oven is cooled to approximately said selected temperature by a flow of air from said air jet means when said air jet means is directed toward said oven;

wherein said air jet means comprises:

a tubular member rotatable about its longitudinal axis; and a nozzle in said tubular member, said food holding means is a grill, said fuel holding means is a grate, and said air jet means further is selectively rotatable to a third position directing said nozzle toward said grate.

2. A cook device comprising;

means for holding fuel, means for holding food to be cooked;

means for selectively enclosing said food holding means to provide an oven;

means for blowing air;

air jet means, in air flow communication with said air blowing means (for) selectively, moveable between a first position directing a jet of air toward the fuel in said fuel holding means (or) and a second position directing air into said oven;

light-sensing means for activating said air blowing means in response to the detecting of an open flame in said fuel holding means, so that said flame is extinguished by a jet of air from said air jet means when said air jet means is directed toward the fuel in said fuel holding means, thereby preventing the charring of said food, and heat sensitive means for activating said air blowing means in response to the presence of a temperature in said oven which is greater than a selected temperature so that said oven is cooled to approximately said selected temperature by a flow of air from said air jet means when said air jet means is directed toward said oven, said cook device further comprising;

a continuous network of heat absorbing, air conducting conduits in air flow communication with said air blowing means and said air jet means.

3. In a fireplace heating device of the type having a grate for holding fuel, a continuous network of air-conducting conduits disposed about said grate, and electrically powered means for blowing air through said conduits to absorb heat therefrom, the improvement comprising:

first means for holding food over said grate;

second means for selectively enclosing said food-holding means to provide an oven;

air-jet means, in communication with one of said conduits, selectively moveable between a first position directing air toward the fuel in said grate and a second position directing air into said oven;

third means for activating said air-blowing means in response to the presence of a flame in said grate, so that a jet of air is directed from said air jet means in said first position to extinguish said flame;

fourth means for activating said air-blowing means in response to the presence of a temperature in said oven which exceeds a selected temperature so that a flow of cooling air is directed from said air jet means in said second position into said oven; and fifth means for activating said air-blowing means independently of said third and fourth means.

4. The device of claim 3, wherein said first means is a grill and said second means comprises:

an open-bottomed enclosure removably disposed on said grill.

5. A cook device comprising means for holding fuel;

means for holding food to be cooked;

means for selectively enclosing said food-holding means to provide an oven;

means for blowing air;

air jet means, in air flow communication with said air-blowing means selectively moveable between a first position directing a jet of air toward the fuel in said fuel holding means and a second position directing air into said oven;

light-sensing means for activating said air blowing means in response to the detecting of an open flame in said fuel-holding means so that said flame is extinguished by a jet of air from said air jet means when said air jet means is directed toward the fuel in said fuel-holding means, thereby preventing the charring of said food, and heat-sensitive means for activating said air blowing means in response to the presence of a temperature in said oven which is greater than a selected temperature so that said oven is cooled to approximately said selected temperature by a flow of air from said air jet means when said air jet means is directed toward said oven;

wherein said air jet means comprises:

a tubular member rotatable about its longitudinal axis; and a nozzle in said tubular member, said food holding means is a grill, said fuel holding means is a grate, and said air jet means further is selectively rotatable to a third position directing said nozzle toward said grate.

6. The device of claim 4, further comprising:

a housing in which said grill is mounted; and means for pivotally attaching said enclosure to said housing so that said enclosure is selectively liftable from, and lowerable over, said grill.

7. The device of claim 3, wherein said third means comprises:

light-sensitive means for detecting the light from said flame; and electrical switching means, responsive to said light-sensitive means for electrically connecting said air-blowing means to a source of electrical current.

8. The device of claim 3, wherein said fourth means comprises:

heat-sensitive means for sensing the temperature in the oven provided by said second means;

electrical switching means, responsive to said heat-sensitive means for electrically connecting said air-blowing means to a source of electrical current when said heat-sensitive means senses a temperature greater than said selected temperature; and means for varying said selected temperature.

9. The device of claim 3, wherein said fifth means comprises:

electrical switching means for selecting the operation of (a) said third means, (b) said fourth means, or (c) said air-blowing means independently of said third and fourth means.

10. The device of claim 3, wherein said air-jet means comprises:

a tubular member, rotatable about its longitudinal axis; and means forming an air jet nozzle in the wall of said tubular member.

* * * * *